United States Patent [19]

Piper

[11] Patent Number: 4,746,769

[45] Date of Patent: May 24, 1988

[54] MULTILAYER WOVEN HIGH DENSITY ELECTRICAL TRANSMISSION CABLE AND METHOD

[75] Inventor: Douglas E. Piper, Greenville, S.C.

[73] Assignee: Woven Electronics Corporation, Mauldin, S.C.

[21] Appl. No.: 772,125

[22] Filed: Sep. 3, 1985

Related U.S. Application Data

[63] Continuation-in-part of Ser. No. 625,660, Jun. 28, 1984, Pat. No. 4,559,411.

[51] Int. Cl.[4] ..... H01B 7/08; D03D 15/00

[52] U.S. Cl. ..... 174/117 M; 29/857; 139/425 R; 174/36; 174/115

[58] Field of Search ..... 174/36, 117 M, 115, 174/32; 29/857; 139/425 R

[56] References Cited

U.S. PATENT DOCUMENTS

| | | | |
|---|---|---|---|
| 3,447,120 | 5/1969 | Rask et al. | 174/117 M |
| 3,582,537 | 6/1971 | Perreault | 174/117 M |
| 3,909,508 | 9/1975 | Ross | 174/117 M |
| 4,095,042 | 6/1978 | Ross | 174/36 |
| 4,143,236 | 3/1979 | Ross et al. | 174/117 M X |
| 4,229,615 | 10/1980 | Orr, Jr. et al. | 174/117 M |
| 4,281,211 | 7/1981 | Tatum et al. | 174/117 F X |
| 4,460,803 | 7/1984 | Piper | 174/36 |
| 4,559,411 | 12/1985 | Piper | 174/117 M |

*Primary Examiner*—Morris H. Nimmo
*Attorney, Agent, or Firm*—Cort Flint

[57] ABSTRACT

A multilayer woven high density electrical transmission cable (A) is disclosed including a first woven cable layer (D) and a second woven cable layer (E) bound together by warp bindings (24) as integral cable structure. Signal conductors (16) and ground conductors (18) extend in the warp direction in cable layer (D). Signal conductors (26) and ground conductors (28) extend in the warp direction in cable layer (E). Signal conductors (16 and 26) are broken out of their respective cable layers either on opposite sides, breakout sections (B,B′), or at the same sides, breakout section (B″) as required for a prescribed program termination. All of the ground conductors (18 or 28) of one cable layer cross over to the side of the other cable layer so that one-hundred percent of the ground conductors (18 and 28) are on the same side at the breakout section for termination. The density of the signal conductors is doubled for a given cable width while affording signal identification for a prescribed termination program.

22 Claims, 4 Drawing Sheets

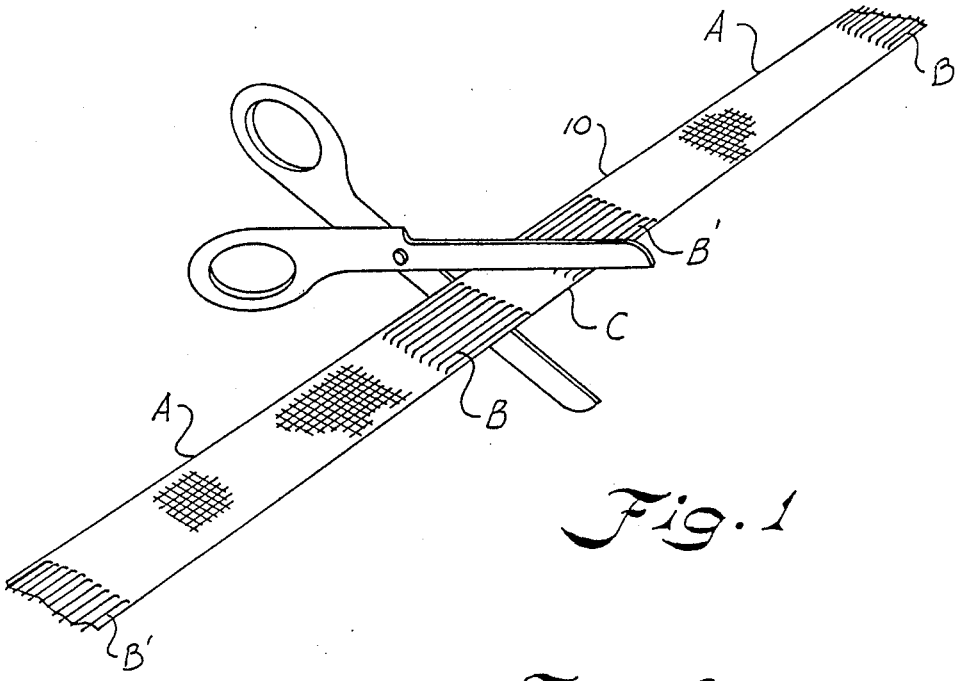
Fig. 1
Fig. 2
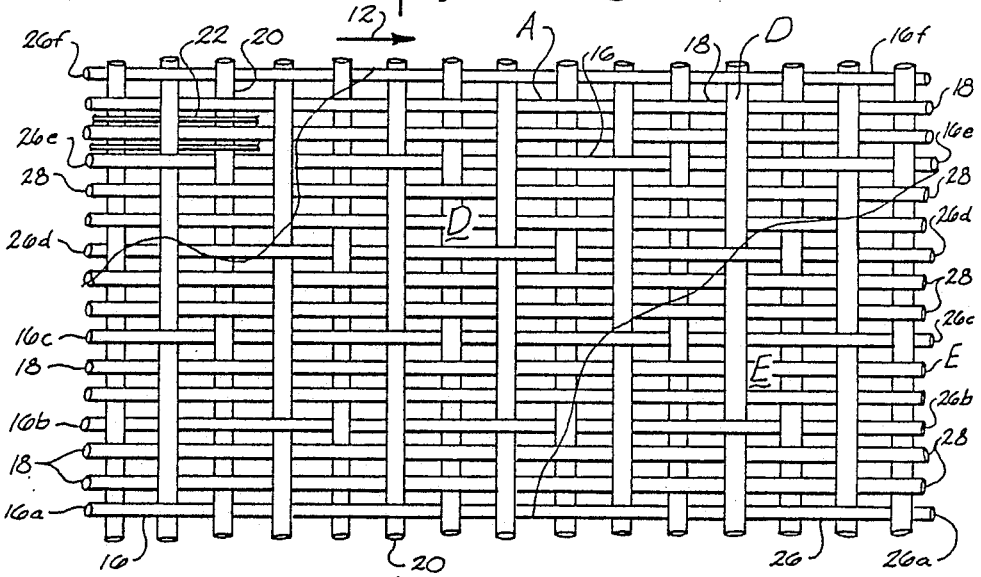
Fig. 2a
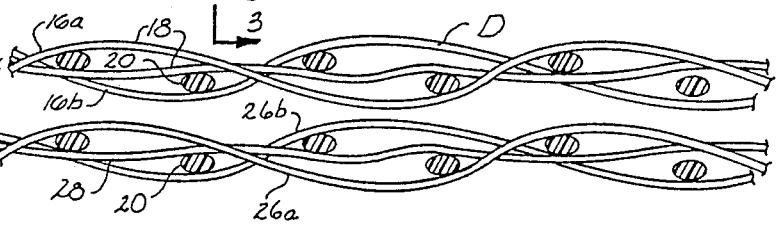

MULTILAYER WOVEN HIGH DENSITY ELECTRICAL TRANSMISSION CABLE AND METHOD

BACKGROUND OF THE INVENTION

This is a continuation-in-part of Ser. No. 625,660, filed June 28, 1984 entitled Unitary Woven Jacket and Electrical Transmission Cable and Method for Production, now U.S. Pat. No. 4,559,411.

The invention relates to flexible, woven high frequency transmission cables of the type which are generally flat and include a plurality of conductors extending in the warp direction which transmit high frequency signals, for example as utilized in communications and computer systems.

With the advent of more sophisticated electronics, the need for higher density signal transmission has occurred. In U.S. Pat. No. 4,143,236 a control impedance cable is disclosed for transmitting high frequency, high speed electrical signals wherein each signal wire is isolated by a pair of exclusive ground wires woven in such a configuration that the impedance and geometry of the signals and ground conductors are fixed in the cable. U.S. Pat. No. 4,460,803 discloses a jacketed controlled impedance cable wherein a control impedance cable and outer woven jacket are made in a unitary construction resulting in the highly desirable abrasion-resistant electrical cable having sufficient flexibility to enable bending of the cable during riding in the chassis of a computer or other machine.

In the above controlled impedance cables, much of the signal conductor capacity is taken up by the ground conductors. If the cable becomes too wide, its use becomes awkward and difficult to route and place in many applications.

The transmission cables may typically have 50 signal conductors and 102 ground conductors for a total of 152 conductor wires.

In terminating a cable, wire identification at the output and input connectors must be made to correspond. If the density is increased the problem of conductor identification at termination increases. For example, if the signal density in a controlled impedance cable is doubled, 304 individual wires need to be terminated at each end of the cable. Thus, it can be seen that the problem or providing high speed transmission cables having increased signal wire densities which can be reliably terminated with undue labor is a problem to which considerable attention need be given.

Flat, ribbon-type electrical conductor cables have been provided heretofore which have either been folded or stacked upon each other. For example, U.S. Pat. No. 3,447,120 discloses an electrical cable assembly wherein a plurality of conductors are stacked upon one another and terminated at a common bus. The conductors may be floated from the weave for termination at the ends of the straight run strip cable. This cable configuration requires conductors arranged in ground planes between the signal conductor cables resulting in a loss of signal conductor density. When arranged in a folded or twisted configuration, the stacked cables buckle causing the conductors to lose their original configuration which may alter the electrical characteristics of the cable.

Accordingly, an object of the present invention is to provide a woven high frequency transmission cable having increased signal density.

Still another object of the present invention is to provide a highly flexible, woven electrical transmission cable having high signal conductor density within a limited width which can be folded or twisted without loss of physical and electrical cable characteristics.

Still another important object of the present invention is to provide a multilayer, high speed, controlled impedance cable having increased signal conductor density, and method therefor, in which the identity of the signal conductors may be prescribed by weaving for reliable termination without undue labor.

SUMMARY OF THE INVENTION

The above objectives are accomplished according to the present invention by providing a woven dual layer controlled impedance cable wherein two layers of electrical transmission cable each having a plurality of electrical conductors are simultaneously woven and bound together by a warp binder in a unitary cable construction. The signal conductors of a first layer of woven control impedance cable and the signal conductors of a second layer of woven control impedance cable are broken out at opposing ends of the cable in prescribed patterns providing for identification and programmed for termination. In one embodiment, the signal conductors at the breakout section on one end cross to the opposite sides, and the signal conductors at the breakout section at the other end of the cable stay on the same side at which they are woven. When the cable is terminated and connected in a U-shaped fold to mating connectors, the identity of signal connection is maintained. Alternately, the signals from the two cable layers may cross over at opposite ends of the cable to break out on opposite sides or may remain on the same side as the cable layer in which they are woven depending on the application being made. A woven tab separates the signal conductors on each side of the tab.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1 is a perspective view illustrating a continuous cable structure woven in accordance with the present invention for forming individual dual layer transmission cables;

FIG. 2 is a top plan view of a dual layer woven high speed transmission cable constructed in accordance with the present invention;

FIG. 2*a* is a sectional view in the warp direction illustrating the weave of the conductor wires extending longitudinally in the warp direction in a woven cable structure according to the invention;

DESCRIPTION OF A PREFERRED EMBODIMENT

Figure 3A:
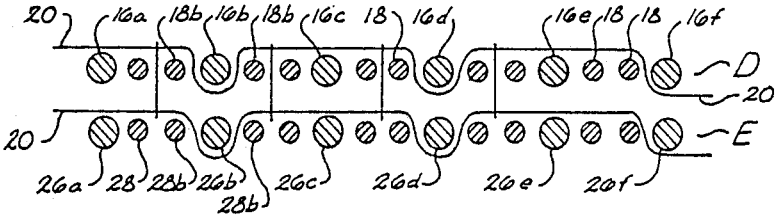
FIG. 3*a* through 3*d* illustrate the four-pick repeat pattern of the weft pick of a multilayer transmission cable structure according to the invention.
Figure 3B:
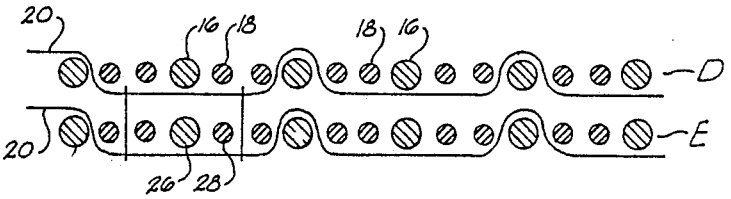
Figure 3C:
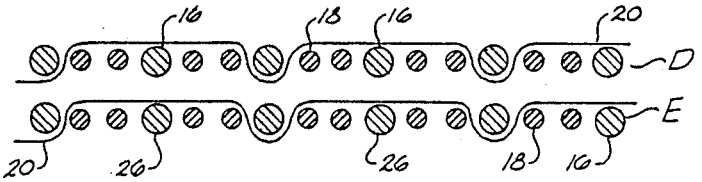
Figure 3D:
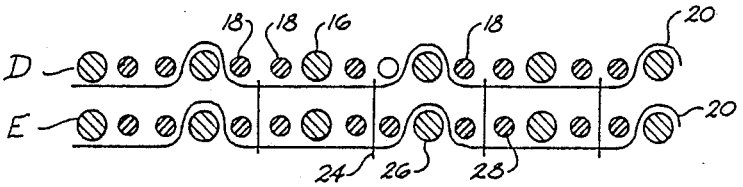

Referring now in more detail to the drawings, FIG. 1 illustrates a continuous length of woven electrical transmission cable structure at 10 which includes a plurality of multilayer cable sections A, a plurality of breakout sections B, and a plurality of cutline sections C. The continuous length cable structure may be cut at C to provide a plurality of individual multilayer cables A.

Multilayer cable A includes a first woven electrical transmission cable layer D and a second woven electrical transmission cable layer E woven simultaneously and bound as unitary multilayer cable structure by warp binder yarns. Cable layers D and E may each be woven in the form of a high speed electrical transmission controlled impedance cable as illustrated in U.S. Pat. No. 4,143,236 hereby incorporated herein by reference. The particulars of the woven construction of each cable layer of the dual layer electrical transmission cable may also be had to the above-referenced U.S. Pat. No. 4,559,411, also incorporated herein by reference.

Referring now in more detail to FIG. 2, it can be seen that the first cable layer D includes a first plurality of warp elements extending longitudinally in a warp direction 12 which include a number of first signal conductors 16 and a number of ground conductors 18 extending in the warp direction. A weft yarn or element 20 is woven with the warp conductors 16 and 18 in a generally plain weave pattern. The warp elements also include a number of warp yarns 22 which are interwoven with the weft yarn 20, and in a prescribed weave pattern which locks the conductors 16 and 18 in their geometrical configuration with respect to the center spacings of the conductors in the cable. This fixes the electrical characteristics of the cable. A number of the warp yarns 22 are utilized as weave elements to bind cables layers D and E unitarily together in the form of warp binder yarns 24.

As can best be seen in FIG. 2*a*, the signal conductors 16 are repetitively woven over two picks and under two picks of the weft element 20. The ground conductors 18 are woven repetitively, over one pick and under one pick of the weft yarn 20. Adjacent signal conductors 16, such as 16*a* and 16*b*, are woven 180 degrees out of phase with each other, meaning that when one is up, the adjacent conductor is down.

Second cable layer E includes a second plurality of warp elements extending longitudinally in the warp direction whereof which include a number of second signal conductors 26 and a number of ground conductors 28 extending in the warp direction. The weft yarn 20 is woven with the warp conductors 26 and 28 in the same plainweave pattern as described for cable layer D. The warp elements in cable layer E also include warp yarns 22 interwoven with the weft yarn 20 to lock the warp signal conductors 26 and 28 in their geometrical configuration with respect to each other in a prescribed weave pattern. The pattern of the signal conductors 26 and ground conductors 28 are identical to the patterns of the signal conductors 16 and ground conductors 18 described in cable layer D above. Thus corresponding signal conductors 16 and 26 will be parallel to each other in layers D and E.

Referring now to FIGS. 3*a* through 3*d*, a four shed repeat pattern is illustrated for multilayer cable A. Eight picks of the weft yarn 20 are woven through cable layers D and E during weaving of the four shed weave pattern. The cable layers D and E are bound tightly together in a unitary cable structure by warp binder yarns 24 which are provided by interweaving warp yarns 22 between adjacent ground conductors 18, 28 between the cable layers D and E.

As can best be seen in FIGS. 3*a* through 3*d*, each cable layer is woven in a four shed repeat pattern, one above the other. There are a pair of ground conductors 18 on each side of each signal conductor 16 in layer D. For example, for 16*b* there is a ground conductor 18*b* on each side thereof. Cable layer E likewise includes a pair of ground conductors 28 on each side of each signal conductor 26, for example, 28*b*, 26*b*, 28*b*. It is to be understood, of course, that other configurations of ground wire numbers and placements, and different types of woven electrical transmission cables may be utilized with the instant convention in a multilayer configuration of the two layers. While cables D and E are illustrated in a plain weave configuration with the conductors bound with cable weft yarn 20 and warp yarns 22, it is to be understood that the cable may also be woven in a conventional twill weave pattern wherein the warp yarns 22 are omitted. In weaving the cable, it is preferable that two warp systems be utilized, and that a single weft 20 be utilized and woven through both the first and second cable layers D and E.

Figure 4:
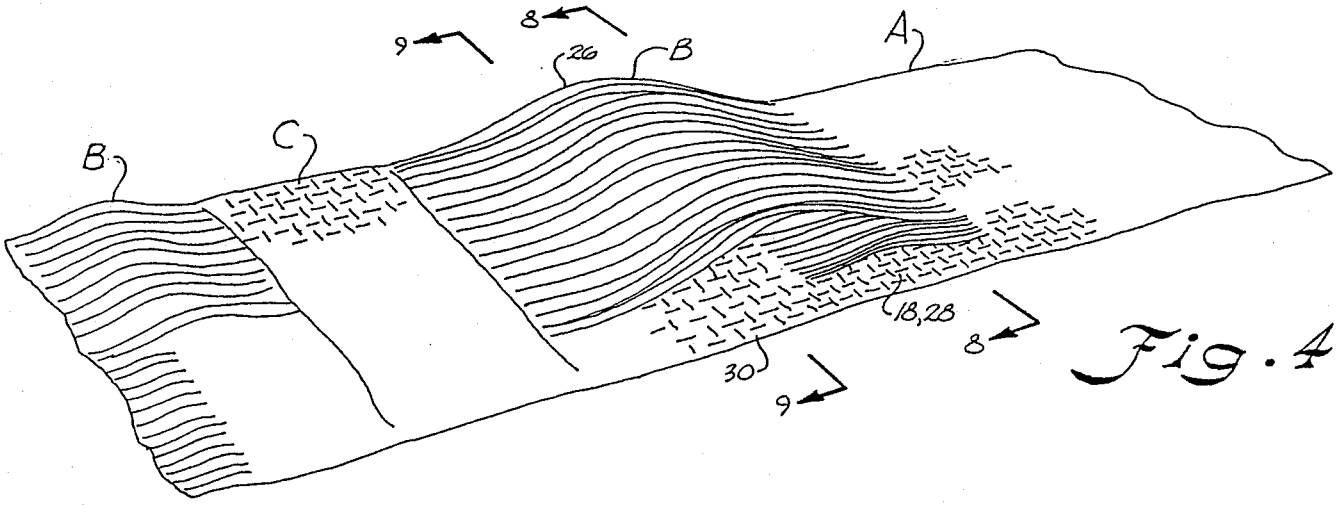
FIG. 4 is a perspective view illustrating a woven multilayer electrical transmission cable having alternating multilayer cable sections, conductor breakout sections, and cutline sections woven in accordance with the present invention.

Referring now to FIG. 4, the multilayer cable and method of the present invention is illustrated as including breakout section B on each end of the multilayer cable A. Following breakout section B is cutline section C which is woven in any manner wherein warp signal conductors 16, 26 and ground conductors 18, 28 are bound with remaining warp yarns 22, warp binder yarn 24 and weft yarn 20. The cutline section delineates where the continuous cable structure 10 may be cut to produce individual multilayer cables A. The weave of cutline section also holds signal conductors 16, 26 and ground conductors 18, 28 together which have been broken out in section B. Each breakout section B includes signal conductors 16, 26 of the cable layers D and E broken out, as can best be seen in FIG. 4, and ground conductors 18, 28 broken out of the weave pattern. The ground conductors 18, 28 again reenter and exit the woven fabric tab 30 of section B for purposes that will be more fully explained later. All of the ground conductors 18, 28 are located on the same side of woven tab 30 while the signal conductors 16, 26 are on the opposite side.

Figure 5:
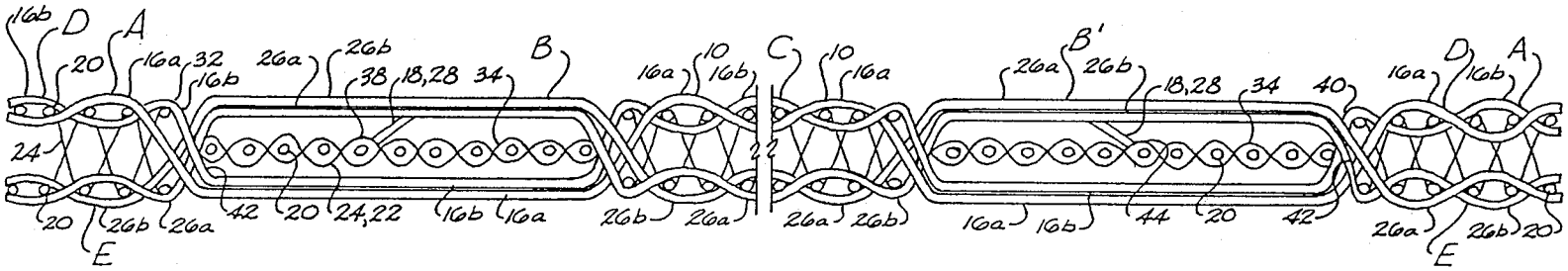
FIG. 5 is a sectional view taken in the warp direction of a continuous woven cable structure having multilayer cable sections, conductor breakout sections, and cutline sections woven in accordance with the present invention.

Viewing the cable structure 10 in FIG. 5 as being woven from left to right, it can be seen that the conductors 16 and 26 break out of a first end 32 of the multilayer cable A at breakout section B and cross over each other. As illustrated in FIG. 5, signal conductors **16*a*, 16*b* of the first cable layer D cross signal conductor 26*a*, 26*b* of second cable layer E. The signal conductors 16*a*, 16*b* and 26*a*, 26*b* are floated out of the weave pattern on opposite sides of the cable structure. The flat woven tab section 30 consists of the warp yarns 22 and weft yarn 20 woven together in a plain weave fabric. All of the ground wires 18, 28 are floated out on one side of the cable structure 10, as can best be seen in FIG. 4. In this case, the ground conductors 18, 28 are broken out on the side of the second signal conductor 26. The signal conductors 26 of the second cable layer E are readily identifiable for termination, as are the first signal conductors 16 of the first cable layer D on the reverse side of the cable. In this manner the large number of signal conductors present in the cable, which may number upwards to 300, can readily be identifiable for termination without undue labor and error. The ground wires 18, 28 are woven in the woven tab 30 until they are broken out at point 38 and floated with the signal conductor 26**.

Following the breakout section B the cutline section C is woven, which again is formed as a short section of the multilayer woven cable A. In cutline section C the first signal conductors **16*a*, 16*b* are once again on top, while the second signal conductors 26*a*, 26*b*** are on the bottom. Other weave patterns may be utilized in the cutline section as long as all of the conductors are bound so that they stay together when the cable is cut across the cutline section.

Following the cutline section C in FIG. 5, a breakout section B′ is woven prior to reaching a second end 40 of multilayer cable A. The crossing over of the signal conductors at the ends of breakout section B′ at point 42 closes any tubular effect of the multilayer cable structure. While the binders 24 are normally sufficient to close and make unitary cable layers D and E, the crossing of the conductors at the ends of the cable has other advantages, such as preventing seepage of potting compound from the terminal connector between the layers, and programmed conductor identification. Construction of breakout section B′ is identical to that previously described for section B, except that the ground conductors 18, 28 enter the woven tab 30 at point 44, having been floated out previously with the upper signal conductors 26. The grounds then enter the woven cable layers D and E to be woven with signal conductors 16, and 26, respectively.

Figure 6:
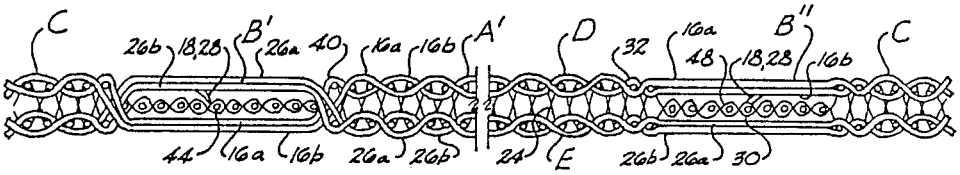
FIG. 6 is a sectional view taken in the warp direction of a continuous cable structure illustrating a multilayer cable and method therefor incorporating a multilayer cable section, conductor breakout sections, and cutline sections woven in accordance with an alternate embodiment of the invention.

Referring now to FIG. 6, a particularly advantageous embodiment of the invention is illustrated. FIG. 6 illustrates a multilayer woven transmission cable A′ constructed in accordance with the present invention wherein the pattern of the breakout of signal conductors 16 and 26 from the first cable layer D and second cable layer E is programmed differently than in FIG. 5. The left-hand breakout section B′ is identical to the breakout section B′ of FIG. 5. However, the breakout section B″ at the first end 32 of the cable is different from section B of FIG. 5. The first signal conductors **16*a*, 16*b* of the first cable layer D are on top of cable A′ on the same side as first cable layer D. The signal conductors 26 of the second cable layer E are on the bottom of the cable A′ on the same side as second cable layer E. The woven tab 30 again separates signals 16 and 26. The ground conductors 18 and 28 are all floated out on top with signal conductors 26 in breakout section B′ and are on top with signal conductor 16 in breakout section B″. The ground conductors 18, 28 all enter the woven tab 30 at 44 in section B′ and break out from tab 30 a 48** in section B″.

Figure 7:
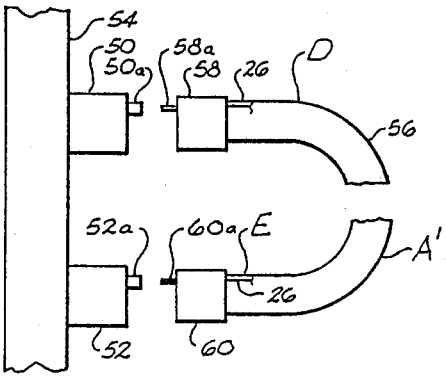
FIG. 7 is a schematic view illustrating application of a multilayer cable woven in accordance with FIG. 6.

In this construction and method, programmed conductor identification and termination may be prescribed for a desired application illustrated in FIG. 7. A pair of vertically spaced socket connectors 50 and 52 are illustrated in FIG. 7 which may be part of a chassis 54 of a piece of equipment such as a computer. The connectors 50 and 52 include sockets **50*a* and 52*a* which are to be connected by a cable of 56 when folded in a U-shaped configuration. At the ends of the cable 56 are pin connectors 58 and 60. In order for a pin 58*a* of the connector 58 to plug into a socket 50*a* of plug 50, and for a corresponding pin 60*a* to plug into socket 52*a* of connector 52, the signal wire 26 carrying the signal between the two connectors must be reversed in the breakout sections B′, B″ for termination to pins 58*a* and 60*a*. The signal conductors 26 is on top at one end of the cable and on the bottom at the other end of the cable. When the cable is folded in the U-shaped form of FIG. 7, the conductor is at the top at both ends. It will be in the proper orientation for termination to the connectors 58 and 60 when the cable is configured in the U-shaped form of FIG. 7**.

Figure 8:
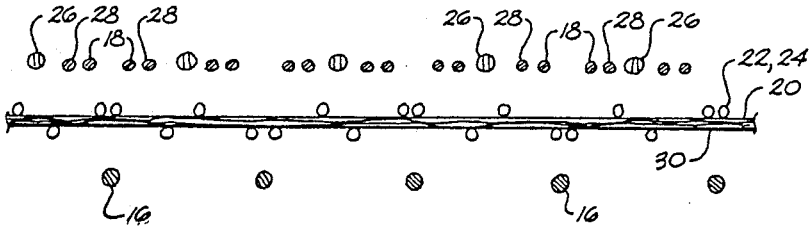
FIG. 8 is a schematic view illustrating a section in a weft direction of a multilayer cable woven in accordance with the present invention as taken through a breakout section.
Figure 9:
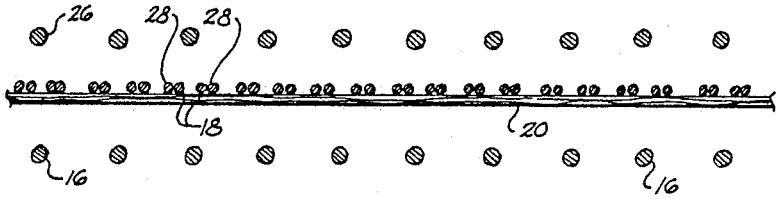
FIG. 9 is a schematic view representing a section taken through a cutline section of a continuous cable structure for a multilayer cable constructed according to the present invention.

Referring now to FIGS. 8 and 9, the representations of the signal conductors 16, 26 and ground conductors 18, 28 will now be described in reference to sections taken along lines 8—8 and lines 9—9 of FIG. 4. In FIG. 8, the second plurality of signal conductors 26 are floated out on top of the cable along with all of the ground conductors 28 from second cable layer E and all the ground conductors 18 from first cable layer D. In this section the weft yarn 20 is interwoven only with the warp yarn 22, warp binder yarn 24. On the opposite side of the woven tab 30 is the first plurality of signal conductors 16 from first cable layer D.

Referring now to FIG. 9, it can be seen that taken along 9—9, all of the ground conductors 18 and 28 are now woven in the woven tab section 30 which includes the woven yarns 22, warp binder yarn 24 and 20. Through section 9—9, the second plurality of second signal conductors 26 still remains on top of the woven section 30 and the first plurality of first signal conductors 16 still remains on the bottom.

It can be seen by referring to FIGS. 8 and 9 that the breakout section B can first be cut across line 9 during termination. The signal conductors 26 may be folded back on top and the signal conductors 16 may be folded back on the bottom. Next, the cable may be cut along line 8 whereupon all the ground conductors 18 and 28 are free for termination. After termination of the ground conductors 18, 28 the signal conductors 26 and 16 may then be brought forward to the terminal connector for termination.

While a preferred embodiment of the invention has been described using specific terms, such description is for illustrative purpose only, and it is to be understood that changes and variations may be made without departing from the spirit or scope of the following claims.

What is claimed is:

1. A woven, high frequency multilayer electrical transmission cable comprising:

(a) a double layer section which includes:

(i) a first woven transmission cable layer including a first plurality of warp elements extending longitudinally in a warp direction in said cable interwoven with a weft element, at least a number of said first plurality of warp elements consisting of first electrical signal conductors; and (ii) a second woven transmission cable layer which includes a second plurality of warp elements extending longitudinally in a warp direction interwoven with said weft element wherein at least a number of said warp elements consist of second electrical signal conductors; and (iii) a plurality of warp binder elements woven between said first and second cable layers binding said first and second cable layers together as integral cable structure;

(b) a breakout section formed at each end of said double layer section including a woven tab section wherein said warp binder elements and said weft element are interwoven together; and (c) said first signal conductors being broken out of said first cable layer on a first side of said double layer section at said breakout section, and said second signal conductors being broken out of said second cable layer on a second side of said double layer section at said breakout section, opposite to said first side; said first and second conductors being broken out in a manner in which said first and second signal conductors are free on either side of said woven tab section for connection to a terminal connector.

2. The cable of claim 1 including a terminal connector electrically connected to said first and second signal conductors at each end of said double layer cable section.

3. The cable of claim 1 wherein a number of said first and second plurality of warp elements of said first and second cable layers consist of a number of ground conductors woven between adjacent signal conductors of each of said first and second cable layers, the geometrical spacing and configuration of said signal conductors and ground conductors in each of said first and second cable layers being such that the characteristic impedance of said woven transmission cable is prescribed and fixed, said first and second signal conductors being woven in an undulating pattern throughout said first and second cable layers; and said first signal conductors of said first cable layer being parallel to said second signal conductors of said second cable layer to preserve the electrical characteristics thereof.

4. The cable of claim 1 including a first number of ground conductors woven in said first cable layer as part of said first plurality of warp elements and a second number of ground conductors woven in said second cable layer as part of said second plurality of warp elements; one of said first or second ground conductors crossing over to the opposite side of said double layer section at each of said breakout sections so that all of said ground conductors are disposed on the same side of said double layer section for termination.

5. A method of producing individual woven multilayer electrical transmission cables comprising:

(a) weaving a continuous length of cable structure which includes a plurality of said multilayer cable sections and a plurality of breakout cable sections, and said breakout cable sections being formed at opposing ends of said multilayer cable sections;

(b) weaving said multilayer cable sections by the steps of:

(i) weaving a first cable layer be weaving a first plurality of warp elements extending longitudinally in a warp direction in said cable layer with a weft element wherein at least a number of said warp elements consists of first electrical signal conductors, (ii) simultaneously weaving a second cable layer by weaving a second plurality of warp elements extending longitudinally in a warp direction in said second cable layer with said weft element wherein at least a number of said warp elements consists of second electrical signal conductors, and binding said first and second cable layers together at points along the length of said multilayer cable section, with warp binder elements woven in between said first and second cable layers, (c) weaving said breakout cable sections by the steps of:

(i) breaking out said fist signal conductors from said first cable layer on one side of said multilayer cable section in a configuration wherein said first signal conductors are not woven with any other elements, (ii) breaking out said second signal conductors from said second cable layer on an opposite side of said multilayer cable sections opposite from said one side in a configuration wherein said second signal conductors are not woven with any other elements, (iii) weaving a woven tab consisting of said weft yarn and the remaining of said warp elements in said first and second cable layers exclusive of said first and second signal conductors, and weaving said woven tab between said first and second conductors for separating said first and second conductors for identification; and (d) severing said cable structure across selective sections of said cable structure to produce individual multilayer transmission cables having a high density of signal conductors.

6. The method of claim 5 including breaking said first signal conductors out of said first cable layer on a side of said multilayer cable section which is opposite the side on which the first cable layer is woven, and breaking said second signal conductors out of said multilayer section on a side which is opposite the side on which said second cable layer is woven.

7. The method of claim 5 including breaking said first signal conductors out of said multilayer section on the side of said first cable layer, and breaking said second signal conductors out of said multilayer section on the side of said second cable layer.

8. The method of claim 5 including breaking said first and second signal conductors out at a first end of said multilayer sections on opposite sides at which they are woven in their respective first and second cable layers; and breaking said first and second signal conductors out at a second end of multilayer cable sections on the same sides at which they are woven in their respective first and second cable layers.

9. The method of claim 5 including weaving a cutline section between two adjacent breakout sections in said continuous length cable structure in which said first and second signal conductors are bound, and severing said cable structure across said cutline sections to separate said cable structure into individual woven multilayer transmission cables.

10. The method of claim 9 wherein said cutline section is woven in the form of said multilayer transmission cable sections.

11. The method of claim 10 wherein said cutline sections have a sufficient length to separate said adjacent breakout sections and which readily distinguish said cutline sections from said multilayer cable sections.

12. The method of claim 5 including weaving a number of ground conductors as warp elements in a prescribed pattern with said signal conductors in each of said first and second cable layers.

13. The method of claim 12 including breaking each of said ground conductors out of said weave pattern on the same side of said multilayer section.

14. The method of claim 12 including breaking each of said ground conductors in said second cable layer out of said second cable layer and crossing each said ground conductor over to the side of said first cable layer in said break out cable section.

15. A method of weaving a high density, high speed multilayer electrical signal transmission cable comprising:

weaving a first cable layer which includes a number of first electrical signal conductors extending longitudinally in the cable layer in a warp direction interwoven with a weft element;

weaving a second cable layer section which includes a number of second electrical signal conductors extending longitudinally in said cable layer in a warp direction interwoven with said weft element;

simultaneously weaving said first and second cable layers in a manner in which said first and second cable layers are flush with one another, and weaving warp binding elements between said first and second cable layers to bind said layers together in said flush configuration as unitary multilayer cable structure;

breaking out said first and second signal conductors at each end of said first and second cable layers on sides of said unitary multilayer cable structure in a manner in which said first and second signal conductors are not woven; and terminating said first and second signal conductors at each end of said first and second cable layers by connection to terminal connectors.

16. The method of claim 15 including crossing said first and second signal conductors broken out from said first and second cable layers to opposite sides of said multilayer cable structure during weaving in a manner that said first and second signal conductors lie on opposite sides of said multilayer cable section from which they are woven in said first and second cable layers.

17. The method of claim 15 wherein first and second signal conductors are broken out of said multilayer cable construction on the same side at which they are woven in said first and second cable layers.

18. The method of claim 15 wherein said first and second signal conductors are broken out on the same side as the side in which they are woven in first and second cable layers at one end of said multilayer cable structure, and said first and second signal conductors cross and are broken out on opposite sides from that at which they are woven in said first and second cable layers at a second end of said multilayer cable structure.

19. The method of claim 15 including weaving a number of ground conductors as warp elements in a prescribed pattern with said signal conductors in each of said first and second cable layers.

20. The method of claim 15 including breaking each of said ground conductors out of said weave pattern on the same side of said multilayer section.

21. The method of claim 15 including breaking each of said ground conductors in said second cable layer out of said second cable layer and crossing each said ground conductor over to the side of said first cable layer in said break out cable section.

22. The method of claim 15 including weaving said signal conductors in each of said first and second cable layers in an undulating pattern and in a manner that corresponding ones of said signal conductors of said first and second cable layers are parallel to each other.

* * * * *